US011308909B2

(12) United States Patent
Chen

(10) Patent No.: US 11,308,909 B2
(45) Date of Patent: Apr. 19, 2022

(54) GATE DRIVER ON ARRAY CIRCUIT

(71) Applicant: Shenzhen China Star Optoelectronics Semiconductor Display Technology Co., Ltd., Shenzhen (CN)

(72) Inventor: Jiangchuan Chen, Shenzhen (CN)

(73) Assignee: SHENZHEN CHINA STAR OPTOELECTRONICS SEMICONDUCTOR DISPLAY TECHNOLOGY CO. LTD., Shenzhen (CN)

( * ) Notice: Subject to any disclaimer, the term of this patent is extended or adjusted under 35 U.S.C. 154(b) by 238 days.

(21) Appl. No.: 16/625,690

(22) PCT Filed: Nov. 18, 2019

(86) PCT No.: PCT/CN2019/119283
§ 371 (c)(1),
(2) Date: Dec. 21, 2019

(87) PCT Pub. No.: WO2021/072889
PCT Pub. Date: Apr. 22, 2021

(65) Prior Publication Data

US 2021/0335309 A1 Oct. 28, 2021

(30) Foreign Application Priority Data

Oct. 14, 2019 (CN) ..... 201910971167.5

(51) Int. Cl.
*G09G 3/36* (2006.01)
*G09G 3/3266* (2016.01)

(52) U.S. Cl.
CPC ..... *G09G 3/3677* (2013.01); *G09G 3/3266* (2013.01); *G09G 2300/043* (2013.01); *G09G 2300/0809* (2013.01); *G09G 2310/06* (2013.01)

(58) Field of Classification Search
CPC ..... G09G 3/3677; G09G 3/3266; G09G 2300/0809; G09G 2300/043; G09G 2310/06
See application file for complete search history.

(56) References Cited

U.S. PATENT DOCUMENTS

2015/0187312 A1 7/2015 Dai
2016/0055815 A1 2/2016 Dai
(Continued)

FOREIGN PATENT DOCUMENTS

CN 103730094 A 4/2014
CN 106683631 A 5/2017
(Continued)

*Primary Examiner* — David Tung
(74) *Attorney, Agent, or Firm* — Luedeka Neely Group, P.C.; Rick Barnes

(57) ABSTRACT

A gate driver on array (GOA) circuit, wherein each of GOA units includes a pull-up control circuit, wherein a control terminal thereof receives a first control signal, and a second terminal thereof outputs a second control signal; a pull-up circuit including a first transistor, wherein a control terminal thereof is connected to the second terminal of the pull-up control circuit, a first terminal thereof receives a first clock signal, and a second terminal thereof outputs a driving signal; a bootstrap capacitor connected between the second terminal of the pull-up control circuit and the second terminal of the first transistor; and a cascade-transmission circuit including a second transistor, wherein a control terminal thereof is connected to the second terminal of the pull-up control circuit, and a second terminal thereof outputs a cascade-transmission signal; wherein a duty cycle of the first clock signal is less than 33%.

15 Claims, 4 Drawing Sheets

(56) References Cited

U.S. PATENT DOCUMENTS

| | | | | |
|---|---|---|---|---|
| 2016/0118003 | A1 | 4/2016 | Dai | |
| 2016/0343322 | A1* | 11/2016 | Xiao | G11C 19/28 |
| 2017/0124971 | A1* | 5/2017 | Tu | G09G 3/3648 |
| 2018/0182339 | A1 | 6/2018 | Zeng | |
| 2018/0190231 | A1 | 7/2018 | Shi et al. | |
| 2018/0211624 | A1* | 7/2018 | Shi | G09G 3/3677 |
| 2018/0366082 | A1 | 12/2018 | Chen et al. | |
| 2019/0066596 | A1 | 2/2019 | Xue et al. | |

FOREIGN PATENT DOCUMENTS

| | | | |
|---|---|---|---|
| CN | 107170411 | A | 9/2017 |
| CN | 107393473 | A | 11/2017 |
| KR | 20170028430 | A | 3/2017 |

* cited by examiner

GATE DRIVER ON ARRAY CIRCUIT

FIELD OF INVENTION

The present invention relates to the technical field of display, and especially to a gate driver on array (GOA) circuit.

BACKGROUND OF INVENTION

With continuing development of display technology, demands of people for high contrast, high resolution, narrow border, and thin panels have become stronger. In order to achieve this goal, current mainstream products of display technologies of liquid crystal display, organic light-emitting diode display, etc. widely adopt gate driver on array (GOA) driving circuits as gate driving circuits.

Currently, most GOA circuits have a pull-up control terminal and a pull-down control terminal connected to each other through an inverter. During a frame, the pull-down control terminal is at a low voltage level only when the pull-up control terminal is at a high voltage level; otherwise, it is at a high voltage level. Therefore, thin-film transistor devices controlled by the pull-down control terminal and thin-film transistor devices in the inverter constantly connected to a high voltage level terminal are easily affected by positive bias temperature stress (PBTS), which results in threshold voltage positive drifting of thin-film transistors, affects pull-down maintaining ability, and therefore results in decreased lifetime of GOA circuits.

SUMMARY OF INVENTION

The present invention provides a GOA circuit, in which an inverter part relinquishes design of constantly connecting to a high voltage level, and an input terminal of the inverter is modified to receive clock signals to resolve the technical problem of the convention GOA circuits that thin-film transistor devices controlled by the pull-down control terminal and thin-film transistor devices in the inverter constantly connected to a high voltage level terminal are easily affected by PBTS, which results in thin-film transistors' threshold voltage positive drifting, affects pull-down maintaining ability, and therefore results in lifetime of GOA circuits decreasing.

In order to resolve the above-mentioned problem, the present invention provides the following technical approach.

The present invention provides A gate driver on array (GOA) circuit, including a plurality of cascaded GOA units, wherein each of the GOA units includes a pull-up control circuit, wherein a control terminal of the pull-up control circuit receives a first control signal, and a second terminal of the pull-up control circuit outputs a second control signal; a pull-up circuit including a first transistor, wherein a control terminal of the first transistor is connected to the second terminal of the pull-up control circuit, a first terminal of the first transistor receives a first clock signal, and a second terminal of the first transistor outputs a driving signal; a bootstrap capacitor connected between the second terminal of the pull-up control circuit and the second terminal of the first transistor; and a cascade-transmission circuit including a second transistor, wherein a control terminal of the second transistor is connected to the second terminal of the pull-up control circuit, a first terminal of the second transistor receives the first clock signal, and a second terminal of the second transistor outputs a cascade-transmission signal; wherein the first control signal is a cascade-transmission signal of a last stage GOA unit or a start signal, and a duty cycle of the first clock signal is less than 33%.

According to at least one embodiment of the present invention, a first terminal of the pull-up control circuit is connected to the control terminal of the pull-up control circuit.

According to at least one embodiment of the present invention, the pull-up control circuit includes a third transistor; a fourth transistor, wherein a first terminal of the fourth transistor is connected to a second terminal of the third transistor, and a second terminal of the fourth transistor is connected to the control terminal of the first transistor; and a fifth transistor, wherein a control terminal of the fifth transistor is connected to the second terminal of the second transistor, a first terminal of the fifth transistor is connected to the first terminal of the fourth transistor, and a second terminal of the fifth transistor is connected to the second terminal of the second transistor.

According to at least one embodiment of the present invention, each of the GOA units further includes a first pull-down circuit, and the first pull-down circuit includes a sixth transistor, wherein a control terminal of the sixth transistor receives a cascade-transmission signal of a next stage GOA unit, a first terminal of the sixth transistor is connected to the second terminal of the first transistor, and a second terminal of the sixth transistor is connected to a first low voltage terminal; a seventh transistor, wherein a control terminal of the seventh transistor is connected to the control terminal of the sixth transistor, and a first terminal of the seventh transistor is connected to the second terminal of the pull-up control circuit; an eighth transistor, wherein a control terminal of the eighth transistor is connected to the control terminal of the seventh transistor, a first terminal of the eighth transistor is connected to a second terminal of the seventh transistor, and a second terminal of the eighth transistor is connected to a second low voltage terminal.

According to at least one embodiment of the present invention, the first terminal of the eighth transistor is connected to the first terminal of the fifth transistor.

According to at least one embodiment of the present invention, each of the GOA units further includes a second pull-down circuit, and the second pull-down circuit includes a ninth transistor, wherein a control terminal of the ninth transistor is connected to an output terminal of an inverter circuit, a first terminal of the ninth transistor is connected to the second terminal of the first transistor, and a second terminal of the ninth transistor is connected to the first low voltage terminal; a tenth transistor, wherein a control terminal of the tenth transistor is connected to the control terminal of the ninth transistor, and a first terminal of the tenth transistor is connected to the second terminal of the pull-up control circuit; an eleventh transistor, wherein a control terminal of the eleventh transistor is connected to the control terminal of the tenth transistor, a first terminal of the eleventh transistor is connected to a second terminal of the tenth transistor, and a second terminal of the eleventh transistor is connected to the second low voltage terminal.

According to at least one embodiment of the present invention, the first terminal of the eleventh transistor is connected to the first terminal of the fifth transistor.

According to at least one embodiment of the present invention, the inverter circuit includes a twelfth transistor; a thirteenth transistor, wherein a control terminal of the thirteenth transistor is connected to a second terminal of the twelfth transistor, a first terminal of the thirteenth transistor receives a second clock signal, and a second terminal of the thirteenth transistor is connected to the control terminal of the ninth transistor; a fourteenth transistor, wherein a control terminal of the fourteenth transistor receives the first clock signal, a first terminal of the fourteenth transistor is connected to the second terminal of the twelfth transistor, and a second terminal of the fourteenth transistor is connected to the second low voltage terminal; a fifteenth transistor, a control terminal of the fifteenth transistor receives the first clock signal, a first terminal of the fifteenth transistor is connected to the second terminal of the thirteenth transistor, and a second terminal of the fifteenth transistor is connected to the second low voltage terminal.

According to at least one embodiment of the present invention, a control terminal and a first terminal of the twelfth transistor receive the second clock signal.

According to at least one embodiment of the present invention, a delay time of the second clock signal relative to the first clock signal is greater than a time when the first clock signal or the second clock signal is at a high voltage level during a clock cycle time.

For a GOA circuit according to the present invention, an inverter part eliminates a design of constantly connecting to a high voltage level, and an input terminal is modified to receive clock signals, which can effectively improve a problem of PBTS. Furthermore, a design of dual low voltage level terminals is adopted, which can restrain leakage current of a pull-up control terminal to extend lifetime of the GOA circuit and improve gate signal output effect.

DESCRIPTION OF DRAWINGS

In order to further understand features and technical contents of the present invention, please refer to the following detailed description and accompanying drawings of the present invention. However, the accompanying drawings are used for purpose of explanation and do not limit the present invention.

With reference to the following drawings, the technical approach and other beneficial effects of the present invention will be obvious through describing embodiments of the present invention in detail.

The drawings are as the following.

FIG. 1 is a schematic diagram of a gate driver on array (GOA) circuit according to an embodiment of the present invention.

FIG. 2 is a circuit diagram of a GOA circuit according to an embodiment of the present invention.

FIG. 3 is a timing diagram of a GOA circuit according to an embodiment of the present invention.

FIG. 4 is a schematic diagram of clock signals received by inverter circuits in various stages of GOA circuits according to an embodiment of the present invention.

FIG. 5 is an oscillogram of outputs of inverter circuits in GOA circuits according to an embodiment of the present invention.

DETAILED DESCRIPTION OF PREFERRED EMBODIMENTS

In order to further describe the technical approach and the effects of the present invention, the following describes in detail with reference to advantageous embodiments and the accompanying drawings of the present invention.

An embodiment of the present embodiment directs to the technical problem of conventional gate driver on array (GOA) circuits that thin-film transistor devices controlled by the pull-down control terminal and thin-film transistor devices in the inverter constantly connected to a high voltage level terminal are easily affected by positive bias temperature stress (PBTS), which results in threshold voltage positive drifting of thin-film transistors, affects pull-down maintaining ability, and therefore results in decreased lifetime of GOA circuits, and the present embodiment can resolve this drawback.

Figure 1:
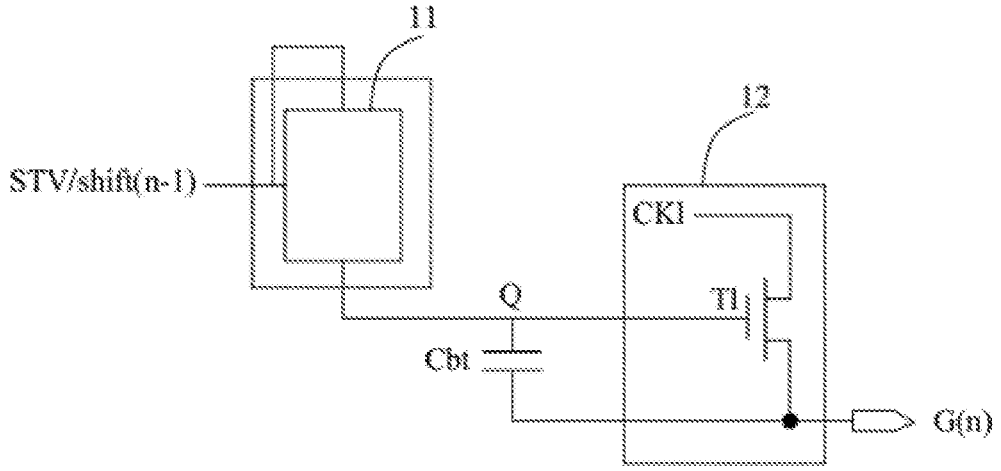

FIG. 1 is a schematic diagram of a GOA circuit according to an embodiment of the present invention. The GOA circuit includes a plurality of cascaded GOA units, wherein each of the GOA units includes a pull-up control circuit 11, wherein a control terminal of the pull-up control circuit 11 receives a first control signal STV/shift(n−1), a first terminal of the pull-up control circuit 11 is connected to the control terminal of the pull-up control circuit 11, and a second terminal of the pull-up control circuit 11 outputs a second control signal Q; a pull-up circuit 12 including a first transistor T1, wherein a control terminal of the first transistor T1 is connected to the second terminal of the pull-up control circuit 11 and receives the second control signal Q, a first terminal of the first transistor T1 receives a first clock signal CK1, and a second terminal of the first transistor T1 outputs a driving signal G(n); and a bootstrap capacitor Cbt connected between the second terminal of the pull-up control circuit 11 and the second terminal of the first transistor T1, which maintains the second control signal Q at a high voltage level when the driving signal G(n) is at a high voltage level.

Figure 2:
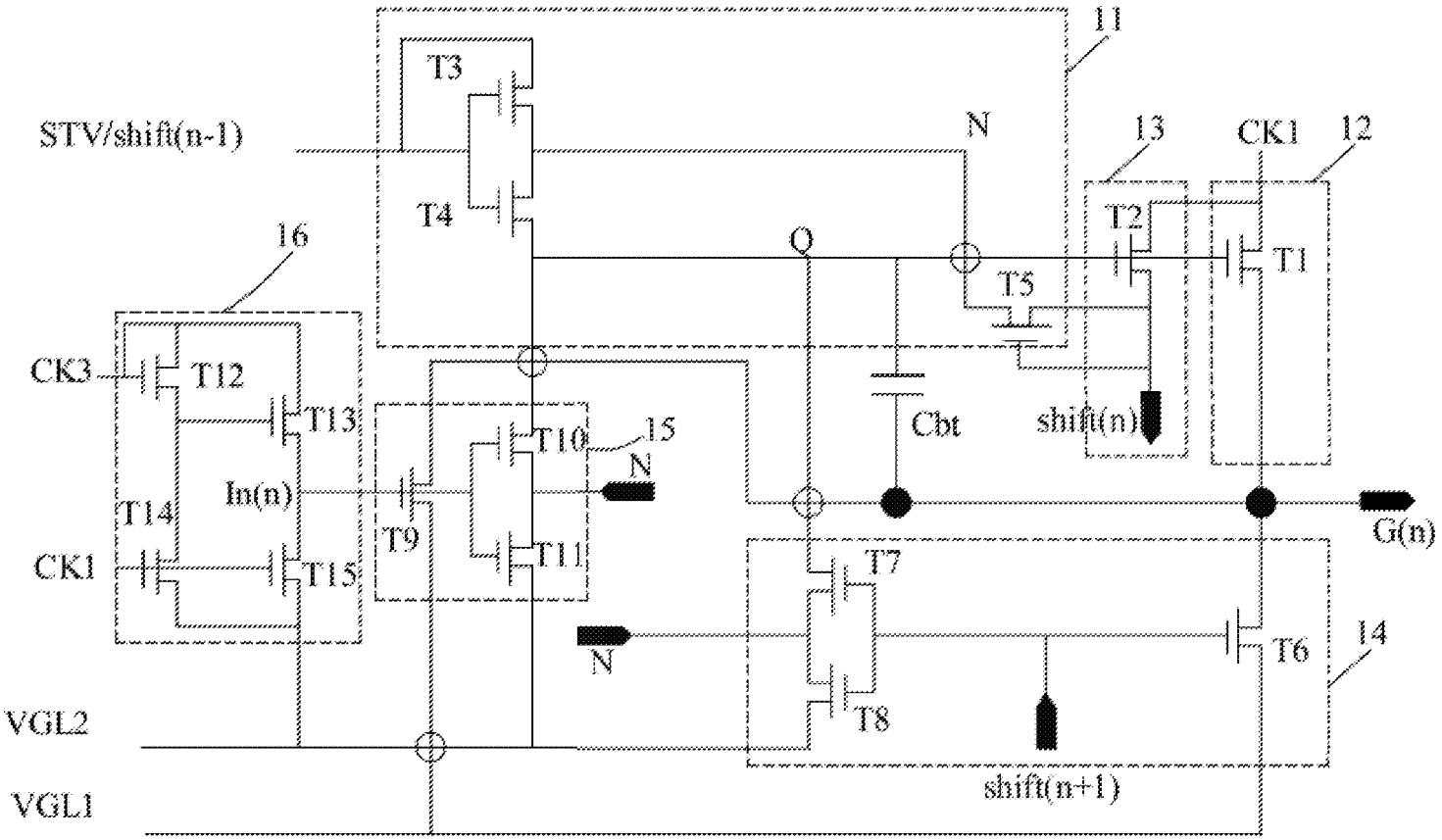

FIG. 2 is a circuit diagram of a GOA circuit according to an embodiment of the present invention. Each of the GOA units further includes a cascade-transmission circuit 13 including a second transistor T2, wherein a control terminal of the second transistor T2 is connected to the second terminal of the pull-up control circuit 11, a first terminal of the second transistor T2 receives the first clock signal, and a second terminal of the second transistor T2 outputs a cascade-transmission signal Shift(n) to be an input of a pull-up control circuit 11 in a next stage GOA unit.

The pull-up control circuit 11 includes a third transistor T3; a fourth transistor T4, wherein a first terminal of the fourth transistor T4 is connected to a second terminal of the third transistor T3, and a second terminal of the fourth transistor T4 is connected to the control terminal of the first transistor T1; and a fifth transistor T5, wherein a control terminal of the fifth transistor T5 is connected to the second terminal of the second transistor T2, a first terminal of the fifth transistor T5 is connected to the first terminal of the fourth transistor T4, and a second terminal of the fifth transistor T5 is connected to the second terminal of the second transistor.

During a scan preparation phase of GOA units, the first control signal STV/shift(n−1) is at a high voltage level, and the first clock signal CK1 is at a low voltage level. When the first control signal STV/shift(n−1) is at a high voltage level, the third transistor T3 and the fourth transistor T4 are conductive, and because a first terminal of the third transistor T3 is connected to the control terminal of the pull-up control circuit 11, the received first control signal STV/shift (n−1) pulls up the second control signal Q. When the second control signal Q is at a high voltage level, the first transistor T1 is conductive. At this time, the first clock signal CK1 is at a low voltage level, and the driving signal G(n) output by the first transistor T1 is at a low voltage level.

During a scan phase of GOA units, the first control signal STV/shift(n−1) is at a low voltage level, and the first clock signal CK1 is at a high voltage level. When the first control signal STV/shift(n−1) is at a low voltage level, the third transistor T3 and the fourth transistor T4 are turned off, and the second control signal Q is maintained at a high voltage level. When the second control signal Q is at a high voltage level, the first transistor T1 is conductive. At this time, the first clock signal CK1 is at a high voltage level, and the driving signal G(n) output by the first transistor T1 is at a high voltage level.

The second transistor T2 operates in an identical manner as that of the first transistor T1 and the description is omitted.

During the scan phase of GOA units, the cascade-transmission signal Shift(n) output by the second transistor T2 is at a high voltage level, the fifth transistor T5 is conductive, and the cascade-transmission signal Shift(n) at a high voltage level is input into the first terminal of the fourth transistor T4 to make a voltage level at the first terminal of the fourth transistor T4 higher than that at a control terminal of the fourth transistor T4 and avoid turning on the fourth transistor T4.

Each of the GOA units further includes a first pull-down circuit 14, and the first pull-down circuit 14 includes a sixth transistor T6, wherein a control terminal of the sixth transistor T6 receives a cascade-transmission signal Shift(n+1) of a next stage GOA unit, a first terminal of the sixth transistor T6 is connected to the second terminal of the first transistor T1, and a second terminal of the sixth transistor T6 is connected to a first low voltage terminal VGL1; a seventh transistor T7, wherein a control terminal of the seventh transistor T7 is connected to the control terminal of the sixth transistor T6, and a first terminal of the seventh transistor T7 is connected to the second terminal of the pull-up control circuit 11; an eighth transistor T8, wherein a control terminal of the eighth transistor T8 is connected to the control terminal of the seventh transistor T7, a first terminal of the eighth transistor T8 is connected to a second terminal of the seventh transistor T7, and a second terminal of the eighth transistor T8 is connected to a second low voltage terminal VGL2. The first terminal of the eighth transistor is connected to the first terminal of the fifth transistor.

When the driving signal G(n) is at a high voltage level, the first transistor T1 and the fifth transistor T5 are conductive, the second control signal Q is at a high voltage level, and the sixth transistor T6, the seventh transistor T7, and the eighth transistor T8 of the first pull-down circuit 14 have to be turned off. At this time, a cascade-transmission signal Shift (n+1) of a next stage GOA unit is at a low voltage level, and by inputting the cascade-transmission signal Shift(n+1) at a low voltage level into the control terminal of the sixth transistor T6, the seventh transistor T7, and the eighth transistor T8, the sixth transistor T6, the seventh transistor T7, and the eighth transistor T8 can be turned off.

After the scan phase of GOA units is over, the sixth transistor T6, the seventh transistor T7, and the eighth transistor T8 of the first pull-down circuit 14 have to be turned on. At this time, a cascade-transmission signal Shift (n+1) of a next stage GOA unit is at a high voltage level, and by inputting the cascade-transmission signal Shift(n+1) at a high voltage level into the control terminal of the sixth transistor T6, the seventh transistor T7, and the eighth transistor T8, the sixth transistor T6, the seventh transistor T7, and the eighth transistor T8 can be turned on.

Figure 3:
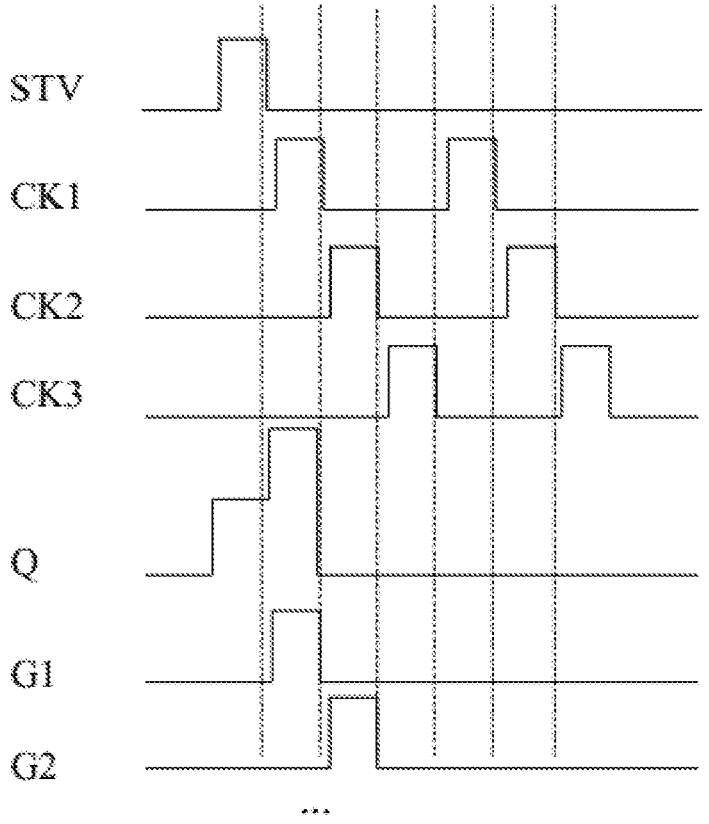

FIG. 3 is a timing diagram of a GOA circuit according to an embodiment of the present invention. Using a first stage GOA unit as an example, a control terminal of the third transistor T3 and the fourth transistor T4 receives a start signal STV (receiving a cascade-transmission signal Shift (n−1) of a previous stage after a second stage), and the first terminal of the first transistor T1 receives the first clock signal CK1.

During the scan preparation phase, the start signal STV is at a high voltage level, and the third transistor T3 and the fourth transistor T4 are conductive and pull up the second control signal Q to make the first transistor T1 conductive. At this time, the first clock signal CK1 is at a low voltage level, and a driving signal G(1) output by the first transistor T1 is at a low voltage level.

During the scan phase, the start signal STV is at a low voltage level, and the third transistor T3 and the fourth transistor T4 are turned off. Because of a coupling effect of the bootstrap capacitor Cbt, voltage level of the second control signal Q is increased to a higher position, and the first transistor T1 remains conductive. At this time, the first clock signal CK1 is at a high voltage level, and a driving signal G(1) output by the first transistor T1 is at a high voltage level.

After the scan phase is over, the first clock signal CK1 is at a low voltage level, at the same time, because a next stage cascade-transmission signal Shift(2) (with a waveform identical to a next stage driving signal G(2)) at a high voltage level is input into the control terminal of the sixth transistor T6, the seventh transistor T7, and the eighth transistor T8, the driving signal G(1) is pulled down, and hence the driving signal G(1) becomes at a low voltage level.

Each of the GOA units further includes a second pull-down circuit 15, and the second pull-down circuit 15 includes a ninth transistor T9, wherein a control terminal of the ninth transistor T9 is connected to an output terminal of an inverter circuit 16, a first terminal of the ninth transistor T9 is connected to the second terminal of the first transistor T1, and a second terminal of the ninth transistor T9 is connected to the first low voltage terminal VGL1; a tenth transistor T10, wherein a control terminal of the tenth transistor T10 is connected to the control terminal of the ninth transistor T9, and a first terminal of the tenth transistor T10 is connected to the second terminal of the pull-up control circuit 11; an eleventh transistor T11, wherein a control terminal of the eleventh transistor T11 is connected to the control terminal of the tenth transistor T10, a first terminal of the eleventh transistor T11 is connected to a second terminal of the tenth transistor T10, and a second terminal of the eleventh transistor T11 is connected to the second low voltage terminal VGL2. The first terminal of the eleventh transistor is connected to the first terminal of the fifth transistor.

The inverter circuit 16 includes a twelfth transistor T12, wherein a control terminal and a first terminal of the twelfth transistor T12 receive a second clock signal CK3; a thirteenth transistor T13, wherein a control terminal of the thirteenth transistor T13 is connected to a second terminal of the twelfth transistor T12, a first terminal of the thirteenth transistor T13 receives the second clock signal CK3, and a second terminal of the thirteenth transistor T13 is connected to the control terminal of the ninth transistor T9; a fourteenth transistor T14, wherein a control terminal of the fourteenth transistor T14 receives the first clock signal CK1, a first terminal of the fourteenth transistor T14 is connected to the second terminal of the twelfth transistor T12, and a second terminal of the fourteenth transistor T14 is connected to the second low voltage terminal VGL2; and a fifteenth transistor T15, wherein a control terminal of the fifteenth transistor T15 receives the first clock signal CK1, a first terminal of the fifteenth transistor T15 is connected to the second terminal of the thirteenth transistor T13, and a second terminal of the fifteenth transistor T15 is connected to the second low voltage terminal VGL2.

Figure 4:
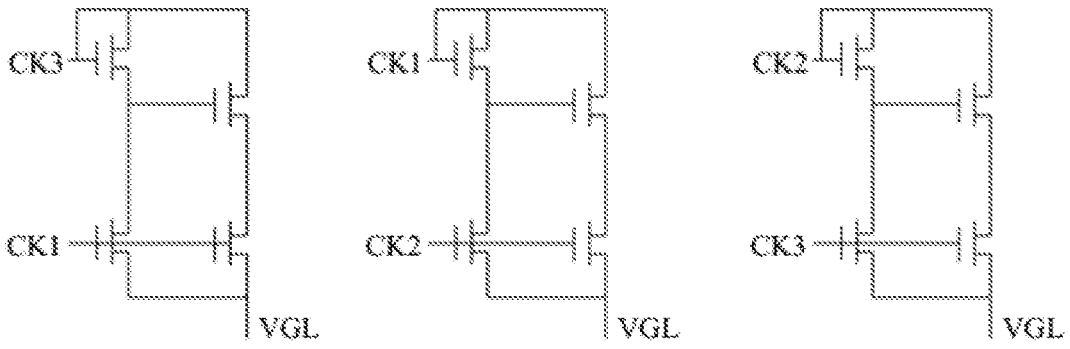
Figure 5:
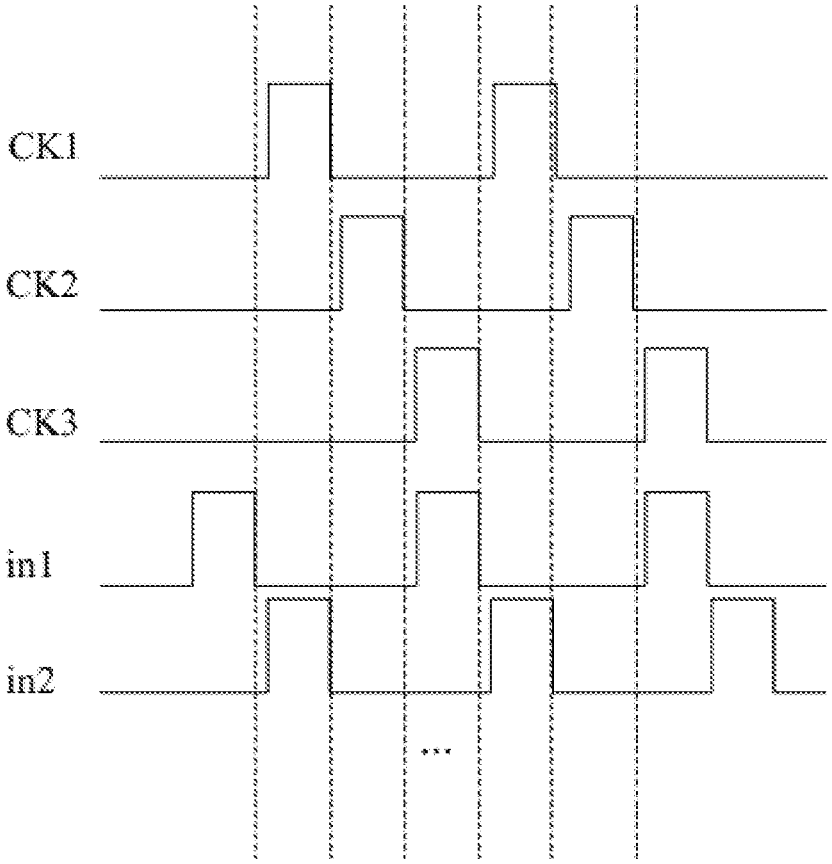

FIG. 4 is a schematic diagram of clock signals received by inverter circuits 16 in various stages of GOA circuits according to an embodiment of the present invention. FIG. 5 is an oscillogram of outputs of inverter circuits 16 in GOA circuits according to an embodiment of the present invention.

A GOA circuit according an embodiment of the present invention is controlled by three ways of clock signals. A first clock signal and a second clock signal of a first stage GOA unit are CK1 and CK3, respectively. A first clock signal and a second clock signal of a second stage GOA unit are CK2 and CK1, respectively. A first clock signal and a second clock signal of a third stage GOA unit are CK3 and CK2, respectively. A duty cycle of the clock signals is less than 33%, and a delay time of the second clock signal relative to the first clock signal is greater than a time when the first clock signal or the second clock signal is at a high voltage level during a clock cycle time. Clock signals of a fourth GOA unit are identical to that of the first GOA unit, clock signals of a fifth GOA unit are identical to that of the second GOA unit, clock signals of a sixth GOA unit are identical to that of the third GOA unit, and so on. The inverter circuit 16 receives corresponding clock signals and outputs a waveform that controls the second pull-down circuit 15 to make the first pull-down circuit 14 and the second pull-down circuit 15 perform a pull-down function alternatively.

Beneficial effects: for a GOA circuit according to an embodiment of the present invention, an inverter part eliminates a design of constantly connecting to a high voltage level, and an input terminal is modified to receive clock signals, which can effectively improve a problem of PBTS. Furthermore, a design of dual low voltage level terminals is adopted, which can restrain leakage current of a pull-up control terminal to extend lifetime of the GOA circuit and improve gate signal output effect.

Although the present invention has been explained in relation to its preferred embodiment, it does not intend to limit the present invention. It is obvious to those skilled in the art having regard to this present invention that other modifications of the exemplary embodiments beyond these embodiments specifically described here may be made without departing from the spirit of the invention. Accordingly, such modifications are considered within the scope of the invention as limited solely by the appended claims.

What is claimed is:

1. A gate driver on array (GOA) circuit, comprising a plurality of cascaded GOA units, wherein each of the GOA units comprises:

a pull-up control circuit, wherein a control terminal of the pull-up control circuit receives a first control signal, and a second terminal of the pull-up control circuit outputs a second control signal;

a pull-up circuit comprising a first transistor, wherein a control terminal of the first transistor is connected to the second terminal of the pull-up control circuit, a first terminal of the first transistor receives a first clock signal, and a second terminal of the first transistor outputs a driving signal;

a bootstrap capacitor connected between the second terminal of the pull-up control circuit and the second terminal of the first transistor; and a cascade-transmission circuit comprising a second transistor, wherein a control terminal of the second transistor is connected to the second terminal of the pull-up control circuit, a first terminal of the second transistor receives the first clock signal, and a second terminal of the second transistor outputs a cascade-transmission signal;

wherein the first control signal is a cascade-transmission signal of a previous stage GOA unit or a start signal, and a duty cycle of the first clock signal is less than 33%, wherein the pull-up control circuit comprises:

a third transistor;

a fourth transistor, wherein a first terminal of the fourth transistor is connected to a second terminal of the third transistor, and a second terminal of the fourth transistor is connected to the control terminal of the first transistor; and a fifth transistor, wherein a control terminal of the fifth transistor is connected to the second terminal of the second transistor, a first terminal of the fifth transistor is connected to the first terminal of the fourth transistor, and a second terminal of the fifth transistor is connected to the second terminal of the second transistor, wherein each of the GOA units comprises a first pull-down circuit, and the first pull-down circuit comprises:

a sixth transistor, wherein a control terminal of the sixth transistor receives a cascade-transmission signal of a next stage GOA unit, a first terminal of the sixth transistor is connected to the second terminal of the first transistor, and a second terminal of the sixth transistor is connected to a first low voltage terminal;

a seventh transistor, wherein a control terminal of the seventh transistor is connected to the control terminal of the sixth transistor, and a first terminal of the seventh transistor is connected to the second terminal of the pull-up control circuit and an eighth transistor, wherein a control terminal of the eighth transistor is connected to the control terminal of the seventh transistor, a first terminal of the eighth transistor is connected to a second terminal of the seventh transistor, and a second terminal of the eighth transistor is connected to a second low voltage terminal.

2. The GOA circuit as claimed in claim 1, wherein a first terminal of the pull-up control circuit is connected to the control terminal of the pull-up control circuit.

3. The GOA circuit as claimed in claim 1, wherein the first terminal of the eighth transistor is connected to the first terminal of the fifth transistor.

4. The GOA circuit as claimed in claim 1, wherein each of the GOA units comprises a second pull-down circuit, and the second pull-down circuit comprises:

a ninth transistor, wherein a control terminal of the ninth transistor is connected to an output terminal of an inverter circuit, a first terminal of the ninth transistor is connected to the second terminal of the first transistor, and a second terminal of the ninth transistor is connected to the first low voltage terminal;

a tenth transistor, wherein a control terminal of the tenth transistor is connected to the control terminal of the ninth transistor, and a first terminal of the tenth transistor is connected to the second terminal of the pull-up control circuit; and an eleventh transistor, wherein a control terminal of the eleventh transistor is connected to the control terminal of the tenth transistor, a first terminal of the eleventh transistor is connected to a second terminal of the tenth transistor, and a second terminal of the eleventh transistor is connected to the second low voltage terminal.

5. The GOA circuit as claimed in claim 4, wherein the first terminal of the eleventh transistor is connected to the first terminal of the fifth transistor.

6. The GOA circuit as claimed in claim 4, wherein the inverter circuit comprises:

a twelfth transistor;

a thirteenth transistor, wherein a control terminal of the thirteenth transistor is connected to a second terminal of the twelfth transistor, a first terminal of the thirteenth transistor receives a second clock signal, and a second terminal of the thirteenth transistor is connected to the control terminal of the ninth transistor;

a fourteenth transistor, wherein a control terminal of the fourteenth transistor receives the first clock signal, a first terminal of the fourteenth transistor is connected to the second terminal of the twelfth transistor, and a second terminal of the fourteenth transistor is connected to the second low voltage terminal; and a fifteenth transistor, wherein a control terminal of the fifteenth transistor receives the first clock signal, a first terminal of the fifteenth transistor is connected to the second terminal of the thirteenth transistor, and a second terminal of the fifteenth transistor is connected to the second low voltage terminal.

7. The GOA circuit as claimed in claim 6, wherein a control terminal and a first terminal of the twelfth transistor receive the second clock signal.

8. The GOA circuit as claimed in claim 7, wherein a delay time of the second clock signal relative to the first clock signal is greater than a time when the first clock signal or the second clock signal is at a high voltage level during a clock cycle time.

9. A gate driver on array (GOA) circuit, comprising a plurality of cascaded GOA units, wherein each of the GOA units comprises:

a pull-up control circuit, wherein a control terminal of the pull-up control circuit receives a first control signal, a first terminal of the pull-up control circuit is connected to the control terminal of the pull-up control circuit, and a second terminal of the pull-up control circuit outputs a second control signal;

a pull-up circuit comprising a first transistor, wherein a control terminal of the first transistor is connected to the second terminal of the pull-up control circuit, a first terminal of the first transistor receives a first clock signal, and a second terminal of the first transistor outputs a driving signal;

a bootstrap capacitor connected between the second terminal of the pull-up control circuit and the second terminal of the first transistor; and a cascade-transmission circuit comprising a second transistor, wherein a control terminal of the second transistor is connected to the second terminal of the pull-up control circuit, a first terminal of the second transistor receives the first clock signal, and a second terminal of the second transistor outputs a cascade-transmission signal;

wherein the first control signal is a cascade-transmission signal of a previous stage GOA unit or a start signal, and a duty cycle of the first clock signal is less than 33%, wherein the pull-up control circuit comprises:

a third transistor;

a fourth transistor, wherein a first terminal of the fourth transistor is connected to a second terminal of the third transistor, and a second terminal of the fourth transistor is connected to the control terminal of the first transistor; and a fifth transistor, wherein a control terminal of the fifth transistor is connected to the second terminal of the second transistor, a first terminal of the fifth transistor is connected to the first terminal of the fourth transistor, and a second terminal of the fifth transistor is connected to the second terminal of the second transistor wherein each of the GOA units comprises a first pull-down circuit, and the first pull-down circuit comprises:

a sixth transistor, wherein a control terminal of the sixth transistor receives a cascade-transmission signal of a next stage GOA unit, a first terminal of the sixth transistor is connected to the second terminal of the first transistor, and a second terminal of the sixth transistor is connected to a first low voltage terminal;

a seventh transistor, wherein a control terminal of the seventh transistor is connected to the control terminal of the sixth transistor, and a first terminal of the seventh transistor is connected to the second terminal of the pull-up control circuit and an eighth transistor, wherein a control terminal of the eighth transistor is connected to the control terminal of the seventh transistor, a first terminal of the eighth transistor is connected to a second terminal of the seventh transistor, and a second terminal of the eighth transistor is connected to a second low voltage terminal.

10. The GOA circuit as claimed in claim 9, wherein the first terminal of the eighth transistor is connected to the first terminal of the fifth transistor.

11. The GOA circuit as claimed in claim 9, wherein each of the GOA units comprises a second pull-down circuit, and the second pull-down circuit comprises:

a ninth transistor, wherein a control terminal of the ninth transistor is connected to an output terminal of an inverter circuit, a first terminal of the ninth transistor is connected to the second terminal of the first transistor, and a second terminal of the ninth transistor is connected to the first low voltage terminal;

a tenth transistor, wherein a control terminal of the tenth transistor is connected to the control terminal of the ninth transistor, and a first terminal of the tenth transistor is connected to the second terminal of the pull-up control circuit; and an eleventh transistor, wherein a control terminal of the eleventh transistor is connected to the control terminal of the tenth transistor, a first terminal of the eleventh transistor is connected to a second terminal of the tenth transistor, and a second terminal of the eleventh transistor is connected to the second low voltage terminal.

12. The GOA circuit as claimed in claim 11, wherein the first terminal of the eleventh transistor is connected to the first terminal of the fifth transistor.

13. The GOA circuit as claimed in claim 11, wherein the inverter circuit comprises:

a twelfth transistor;

a thirteenth transistor, wherein a control terminal of the thirteenth transistor is connected to a second terminal of the twelfth transistor, a first terminal of the thirteenth transistor receives a second clock signal, and a second terminal of the thirteenth transistor is connected to the control terminal of the ninth transistor;

a fourteenth transistor, wherein a control terminal of the fourteenth transistor receives the first clock signal, a first terminal of the fourteenth transistor is connected to the second terminal of the twelfth transistor, and a second terminal of the fourteenth transistor is connected to the second low voltage terminal; and a fifteenth transistor, wherein a control terminal of the fifteenth transistor receives the first clock signal, a first terminal of the fifteenth transistor is connected to the second terminal of the thirteenth transistor, and a second terminal of the fifteenth transistor is connected to the second low voltage terminal.

14. The GOA circuit as claimed in claim 13, wherein a control terminal and a first terminal of the twelfth transistor receive the second clock signal.

15. The GOA circuit as claimed in claim 14, wherein a delay time of the second clock signal relative to the first clock signal is greater than a time when the first clock signal or the second clock signal is at a high voltage level during a clock cycle time.

* * * * *